US006527544B1

(12) United States Patent
Salter et al.

(10) Patent No.: US 6,527,544 B1
(45) Date of Patent: Mar. 4, 2003

(54) PUMPKIN/FRUIT DISPLAY STAND

(76) Inventors: Michael Leavon Salter, 1900 Hwy. 161 S., York, SC (US) 29745; Brenda Charlene Salter, 1900 Hwy. 161 S., York, SC (US) 29745

( * ) Notice: Subject to any disclaimer, the term of this patent is extended or adjusted under 35 U.S.C. 154(b) by 0 days.

(21) Appl. No.: 09/690,484

(22) Filed: Oct. 17, 2000

Related U.S. Application Data

(60) Provisional application No. 60/159,964, filed on Oct. 18, 1999.

(51) Int. Cl.[7] ..... F21V 35/00

(52) U.S. Cl. ..... 431/253; 431/291; 431/297; 362/127; 362/415; 362/431; 362/808

(58) Field of Search ..... 431/253, 288, 431/291, 296, 297; 362/127, 410, 414, 415, 437, 431, 443, 808, 806, 809; 108/23, 28, 50.11, 50.12; 248/127, 146

(56) References Cited

U.S. PATENT DOCUMENTS 273,103 A * 2/1883 Keibel ..... 431/297
1,957,763 A * 5/1934 Dupler ..... 362/809
3,752,430 A * 8/1973 Kenyon et al. ..... 362/431
5,420,773 A * 5/1995 Huang ..... 362/414
5,954,426 A * 9/1999 Whittington ..... 362/414
6,029,937 A * 2/2000 Funaro ..... 248/146
6,454,441 B1 * 9/2002 Lin ..... 362/806

* cited by examiner

*Primary Examiner*—Sara Clarke
(74) *Attorney, Agent, or Firm*—Adams, Schwartz & Evans, p.a.

(57) ABSTRACT

A display stand for displaying at least one object such as a pumpkin thereon, comprising a support including an upper end and a lower end, wherein the lower end is adapted for maintaining the support in a generally upright position relative to a surface upon which the support is placed. A base is connected to the upper end of the support and includes an up per surface for receiving and supporting the object thereon, and the upper surface defines a threaded bore extending therethrough. The display stand also includes a complementary elongate threaded member adapted for being matingly threaded into the bore. The elongate threaded member extends in an upright direction above the upper surface for securing the object thereto, thereby stabilizing the object on the base.

11 Claims, 6 Drawing Sheets

PUMPKIN/FRUIT DISPLAY STAND

This application claims priority to provisional application Ser. No. 60/159,964 filed on Oct. 18, 1999.

TECHNICAL FIELD AND BACKGROUND OF THE INVENTION

This invention relates to a stand for displaying objects such as pumpkins or other fruits or vegetables. While the invention may be used at any time during the year, it is particularly intended for use during the Halloween season, when many individuals display carved pumpkins, or "jack-o-lanterns", on the front porches or in the front yards of their residence. Most jack-o-lanterns are simply placed directly on the porch or ground, or onto a temporary support such as a bale of hay or straw. Unfortunately, displaying jack-o-lanterns using such techniques may attract vermin, permit decayed material to be scattered, or create an increased risk of fire if a wax candle is being used to light the interior of the pumpkin.

The display stand according to the present invention provides a safe yet visually effective alternative for displaying objects such as pumpkins or other fruits and vegetables. The display stand includes decorative matter in keeping with the theme of the season, and provides not only a way of securely holding the pumpkin or other object on the display stand, but also a safe means of lighting the inside of the pumpkin or other object.

SUMMARY OF THE INVENTION

Therefore, it is an object of the invention to provide a display stand which provides a safe and effective means for displaying an object such as a pumpkin, or other fruits or vegetables.

It is another object of the invention to provide a display stand which provides a support for positioning an object such as a pumpkin or other fruits or vegetables high above the ground, thus reducing the possibility of attracting vermin to the display.

It is another object of the invention to provide a display stand for an object such as a pumpkin, or other fruits or vegetables, which provides a stable support for preventing the object displayed thereon from falling to the ground.

It is another object of the invention to provide a display stand for an object such as a pumpkin which provides a means of safely lighting the interior of the object, thereby reducing the risk of fire.

It is another object of the invention to provide a display stand for an object such as a pumpkin or other fruits or vegetables, which includes decorations on the display stand appropriate to the Halloween season.

These and other objects of the present invention are achieved in the preferred embodiments disclosed below by providing a display stand for displaying at least one object such as a pumpkin thereon, including a support having an upper end and a lower end, wherein the lower end is adapted for maintaining the support in a generally upright position relative to a surface upon which the support is placed. A circular base is connected to the upper end of the support and includes an upper surface for receiving and supporting the object thereon, and the upper surface defines a threaded bore extending therethrough. The display stand also includes a complementary elongate threaded member adapted for being matingly threaded into the bore. The elongate threaded member extends in an upright direction above the upper surface for securing the object thereto, thereby stabilizing the object on the base.

According to one preferred embodiment of the invention, the display stand includes a holder affixed to the elongate threaded member for supporting a lighting device for lighting the interior of the object.

According to another preferred embodiment of the invention, the support is formed from a material selected from a group comprising iron, steel, wood, brass, concrete and plastic.

According to yet another preferred embodiment of the invention, the circular base is formed from a material selected from a group comprising iron, steel, wood, brass and plastic.

According to yet another preferred embodiment of the invention, the support comprises at least one elongate leg.

According to yet another preferred embodiment of the invention, the lower end of the support is further adapted to permit penetration of the lower end into the surface upon which the support is placed.

According to yet another preferred embodiment of the invention, the support is, a tripodal structure for maintaining the object in an upright position relative to the surface upon which the support is placed.

According to yet another preferred embodiment of the invention, the circular base has a diameter between 12 and 24 inches.

According to yet another preferred embodiment of the invention, the height of the support is between 24 and 72 inches.

According to yet another preferred embodiment of the invention, the height of the support is 36 inches.

According to yet another preferred embodiment of the invention, the support includes a three-dimensional body molded with a predetermined sculptural design.

According to yet another preferred embodiment of the invention, the predetermined sculptural design is selected from a group comprising skulls, bones, skeletons and a ghost.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
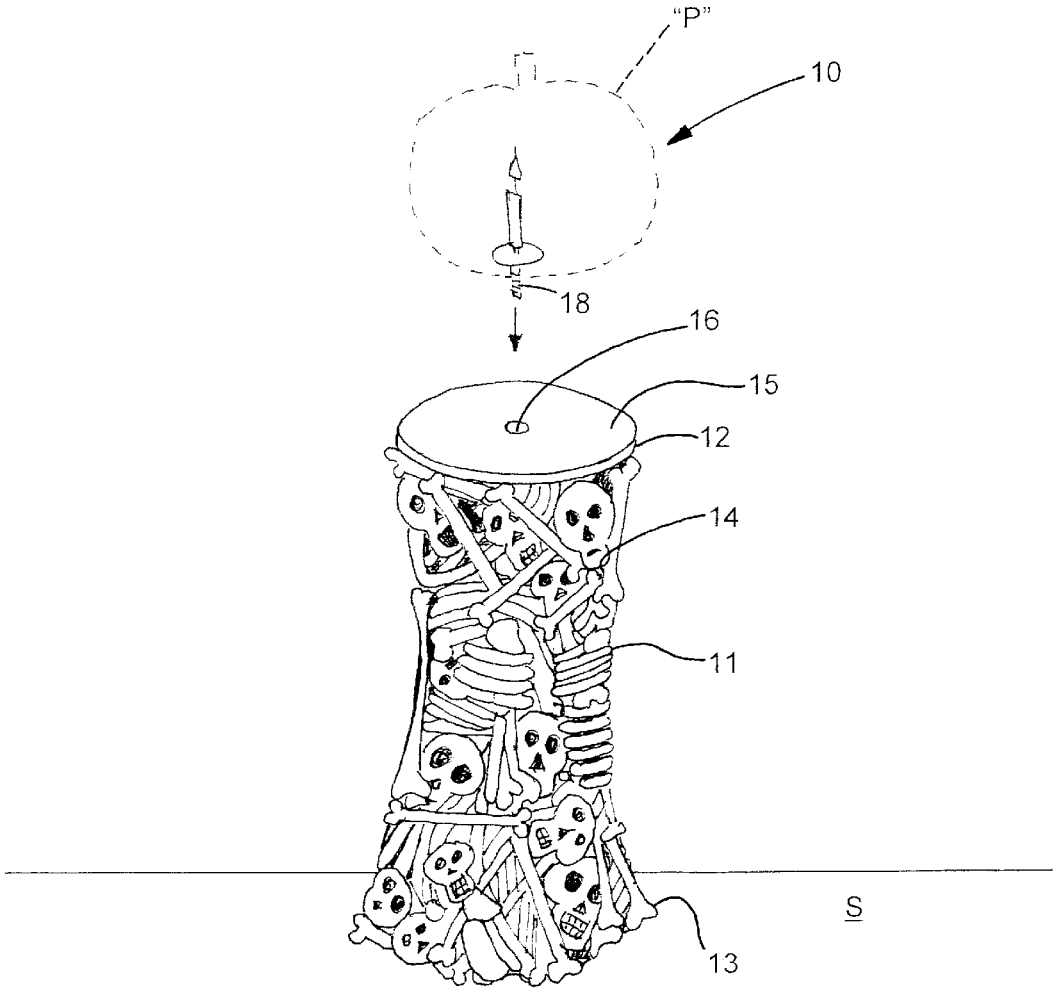
FIG. 1 is a perspective view of a display stand according to one embodiment of the invention.

Referring now specifically to the drawings, a display stand according to the present invention is illustrated in FIG.

1 and shown generally at reference numeral 10. The display stand 10 includes a three dimensional body 11 having respective upper and lower ends 12 and 13, and a surface 14 which is molded into skull and bone shapes. A flat circular base 15 is connected to upper end 12 for supporting an object such as a pumpkin "P". A threaded bore 16 is defined by and extends through the base 15. As discussed in detail below, the bore 16 cooperates with a complementary elongate threaded member 18 such as a metal or plastic rod, bar or pin, to provide a means for safely and securely supporting the pumpkin "P" on the base 15. See FIG. 5. The lower end 13 of the body 11 maintains the stand 10 in a generally upright position relative to a surface "S" upon which the stand 10 is placed.

While the surface 14 of the body 11 is preferably molded into skull and bone shapes, the surface 14 may alternatively be molded into any other suitable Halloween-related or other seasonally-themed shapes intended to frighten or entertain an observer. Although the stand 10 preferably has a height of 36 inches, the stand 10 may be any suitable height, including but not limited to a height between 18 inches and 72 inches.

Figure 2:
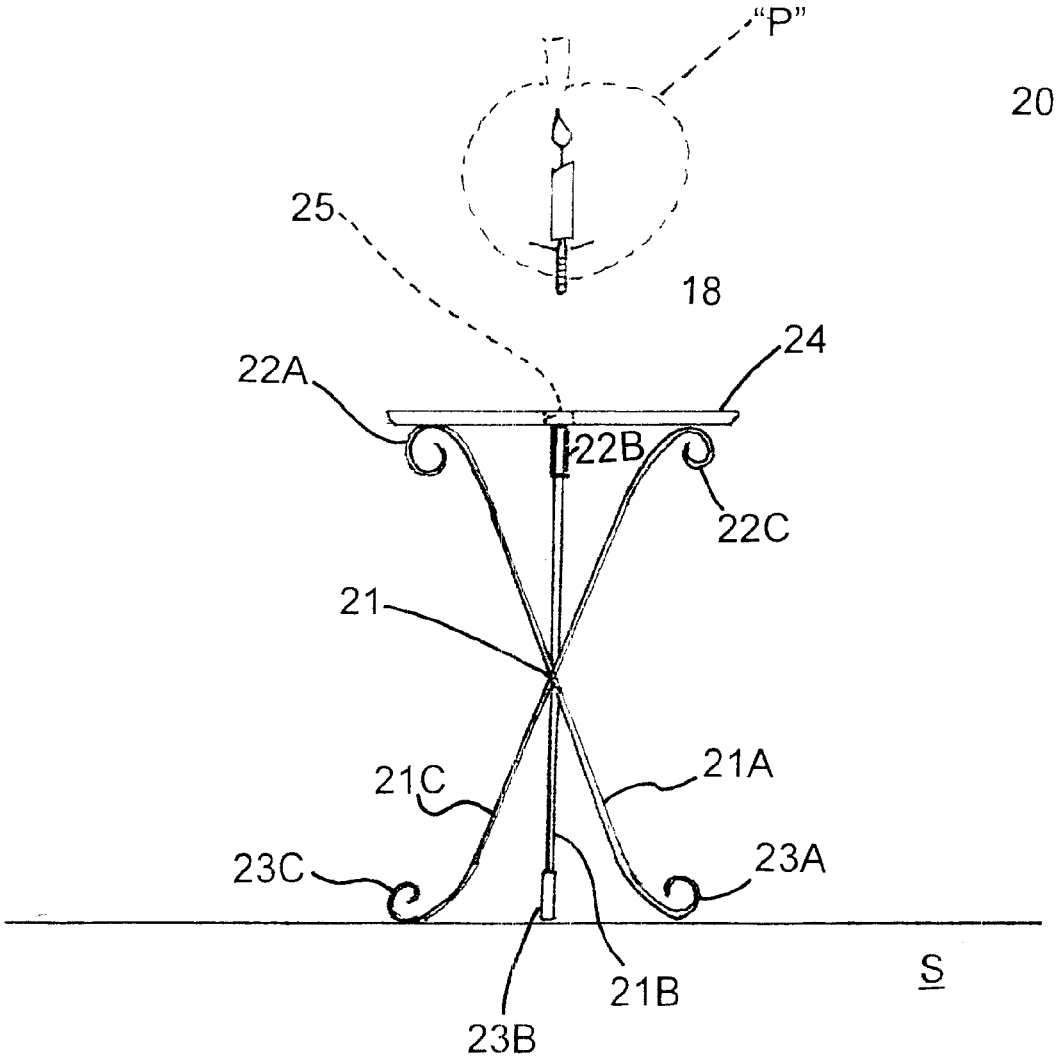
FIG. 2 is a side elevation of another display stand according to an alternative embodiment of the invention.

Referring now to FIG. 2, a display stand according to an alternative embodiment of the invention is shown generally at reference numeral 20. The display stand 20 includes a support 21 formed from three legs 21A, 21B, and 21C, which are crossed in the manner shown and attached together to form a tripodal shape. Each leg 21A, 21B and 21C includes a respective upper end 22A, 22B and 22C, and a respective lower end 23A, 23B and 23C. Lower ends 23A, 23B, 23C are shaped to maintain the stand 20 in a generally upright position relative to a surface "S" upon which the stand 20 is placed. A flat, circular base 24 for supporting an object such as the pumpkin "P" shown, or other fruits or vegetables is attached to upper ends 22A, 22B and 22C. As is further explained and illustrated with reference to FIG. 5, a threaded bore 25 is defined in and extends through the base 24. A complementary threaded member 18, such as a metal or plastic rod, bar or pin, cooperates with the bore 25 for providing a means for safely and securely supporting the pumpkin "P" on the base 24.

The support 21 and base 24 may be formed of any suitable material, such as iron, steel, brass or wood. Furthermore, although the support 21 preferably includes three legs 21A, 21B and 21C, the particular number of legs used is arbitrary. Any number of legs, each having any desired configuration, may alternatively be employed.

Figure 3:
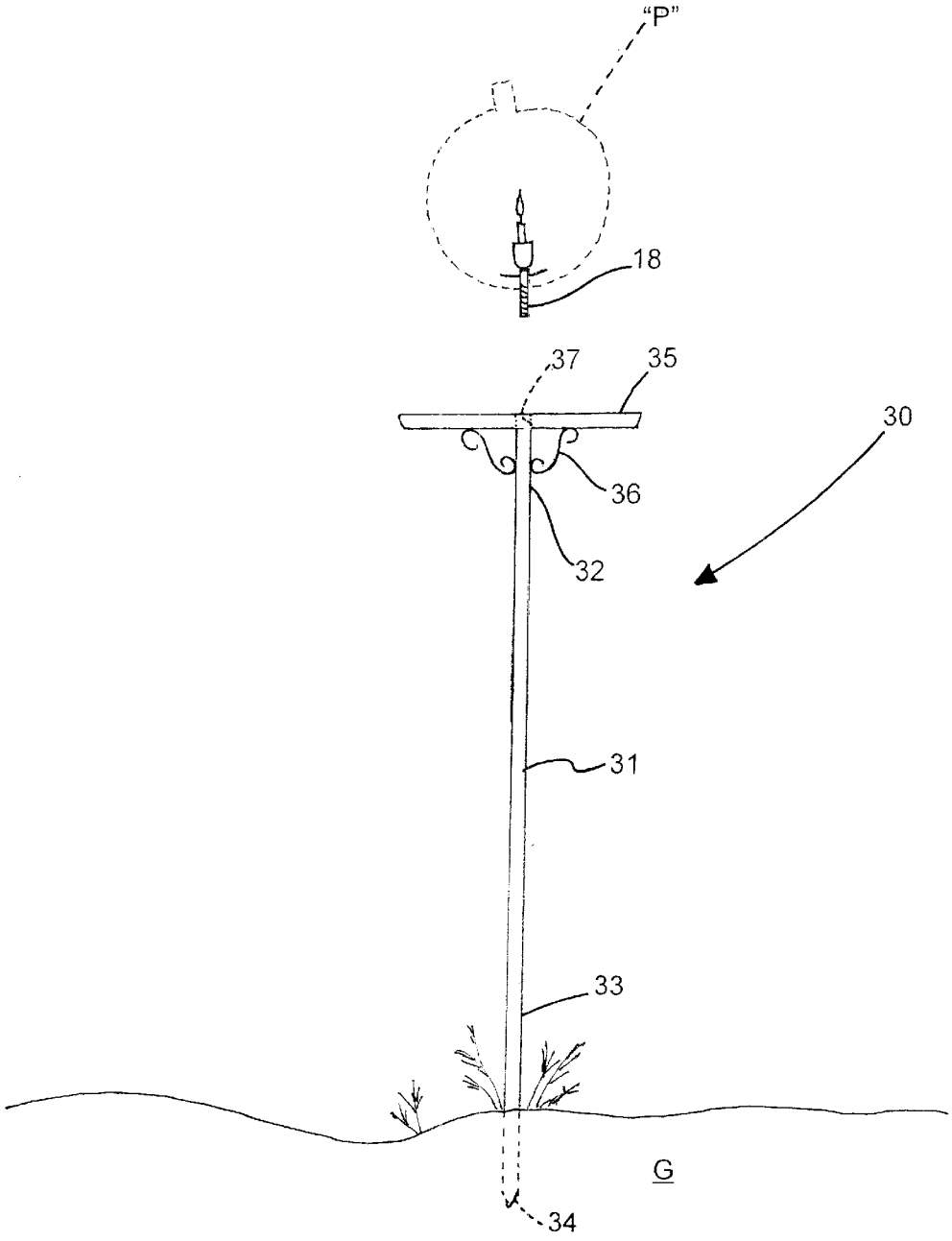
FIG. 3 is a side elevation of another display stand according to an alternative embodiment of the invention.

Referring now to FIG. 3, a display stand according to another alternative embodiment of the invention is shown generally at reference numeral 30. The stand 30 includes a support 31 having respective upper and lower ends 32 and 33. Support 31 is preferably formed from a single elongate pole or post-like structure. The lower end 33 is tapered and terminates at a point 34, which permits the lower end 33 to be inserted into the ground "G" a sufficient distance to provide adequate support for maintaining the stand 30 in a generally upright position.

The stand 30 also includes a flat circular base 35, which is attached in a suitable manner to the upper end 32 of the support 31 using a plurality of supporting braces 36. As is discussed in further detail below in reference to FIG. 5, a threaded bore 37 is defined in and extends through the base 35. The bore 37 cooperates with a complementary threaded member 18, such as a metal or plastic rod, bar or pin, to safely and securely support an object such as the pumpkin "P" shown on the base 35. The support 31 and base 35 may be formed of any suitable material, including but not limited to, iron, steel or wood. Although the support 31 may be any desired length, a preferred length is between 2 feet and 6 feet.

Figure 4:
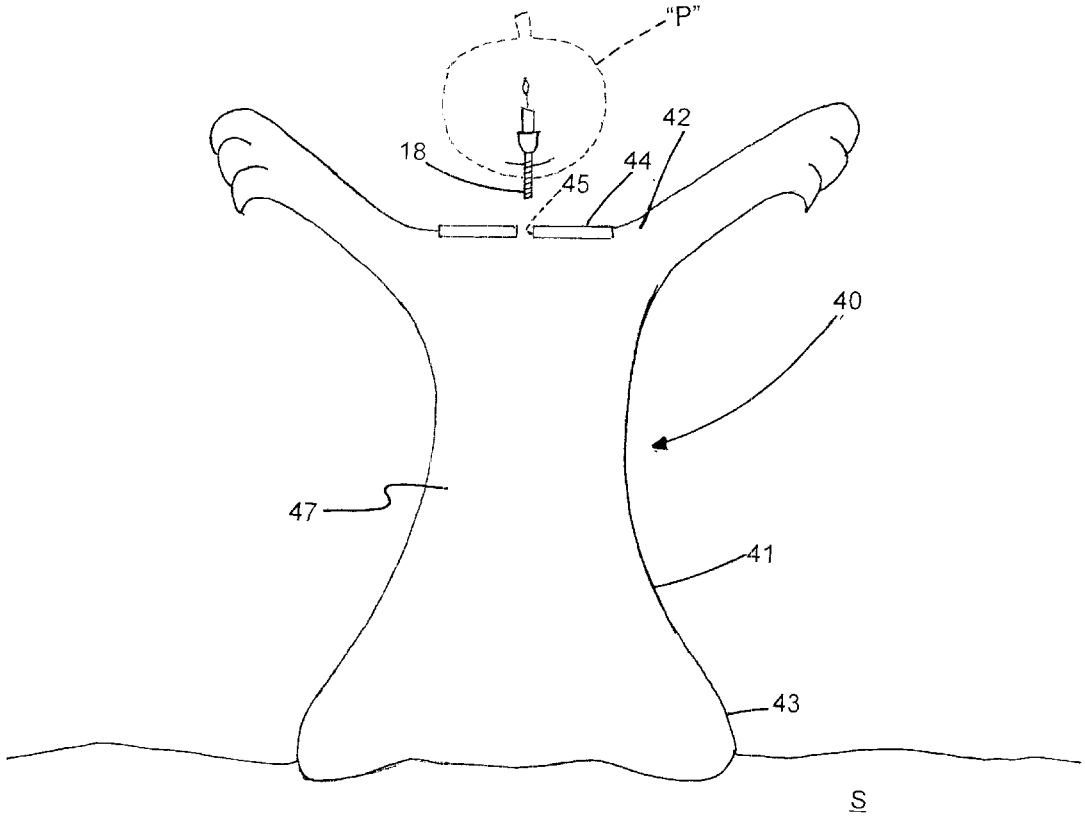
FIG. 4 is a side elevation of yet another display stand according to an alternative embodiment of the invention.

As is shown in FIG. 4, the support 41 includes a three-dimensional body 47 which is molded into the shape of a headless ghost. While the support 41 may be formed from any suitable material, the support 41 is preferably formed from plastic or concrete. Furthermore, although the body 47 of the support 41 is shown in FIG. 4 molded into the shape of a headless ghost, the body 47 may alternatively be molded into any other suitable Halloween-related shape or other appropriate seasonal theme, including but not limited to, a scarecrow, spider, bat, black cat, witch, monster claw, mummy, vampire or other Halloween character or shape. As is shown in FIG. 4, the support 41 may be formed as a unitary structure. The support may alternatively include one or more legs which are surrounded by the body 47 (not shown). While the support 41 may be any suitable height, including but not limited to a height between 18 inches and 72, a preferred height is 36 inches.

The circular bases 15, 24, 35, and 44 are each shown in FIGS. 1, 2, 3, and 4, respectively, ready to display an object such as the pumpkin "P" shown. However, any suitable fruits, vegetables or other seasonal or Halloween-related decorative items may alternatively rely be positioned on the bases 15, 24, 35, and 44. The bases 15, 24, 35, and 44 may also be formed of any suitable material, including but not limited to concrete, plastic or wood, and are each preferably between 12 inches and 24 inches in diameter. Furthermore, although each of the bases 15, 24, 35 and 44 preferably has a circular shape, other shapes, such as diamond, square, triangular or different polyhedron shapes may also be employed.

Figure 5:
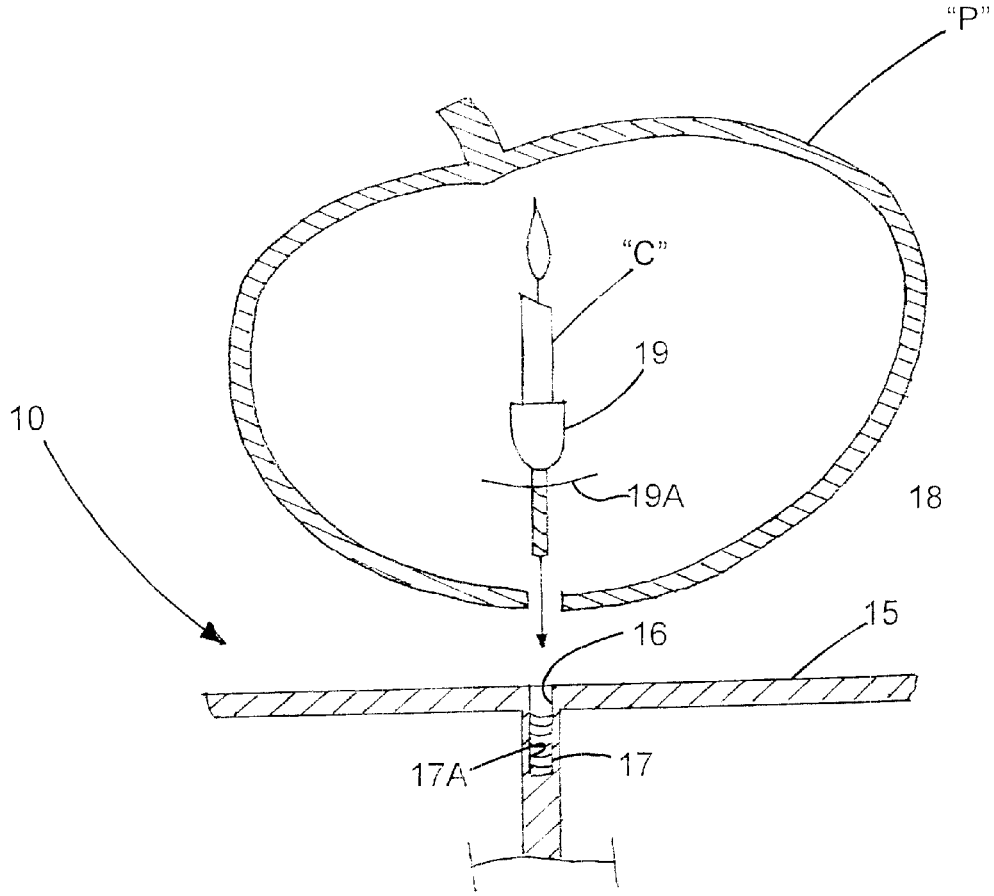
FIG. 5 is a partial, cross-sectional view of the circular base of the display stand, illustrating one way in which a pumpkin may be supported on the display stand according to any of the embodiments of the invention shown in FIGS. 1, 2, 3 or 4.
Figure 6:
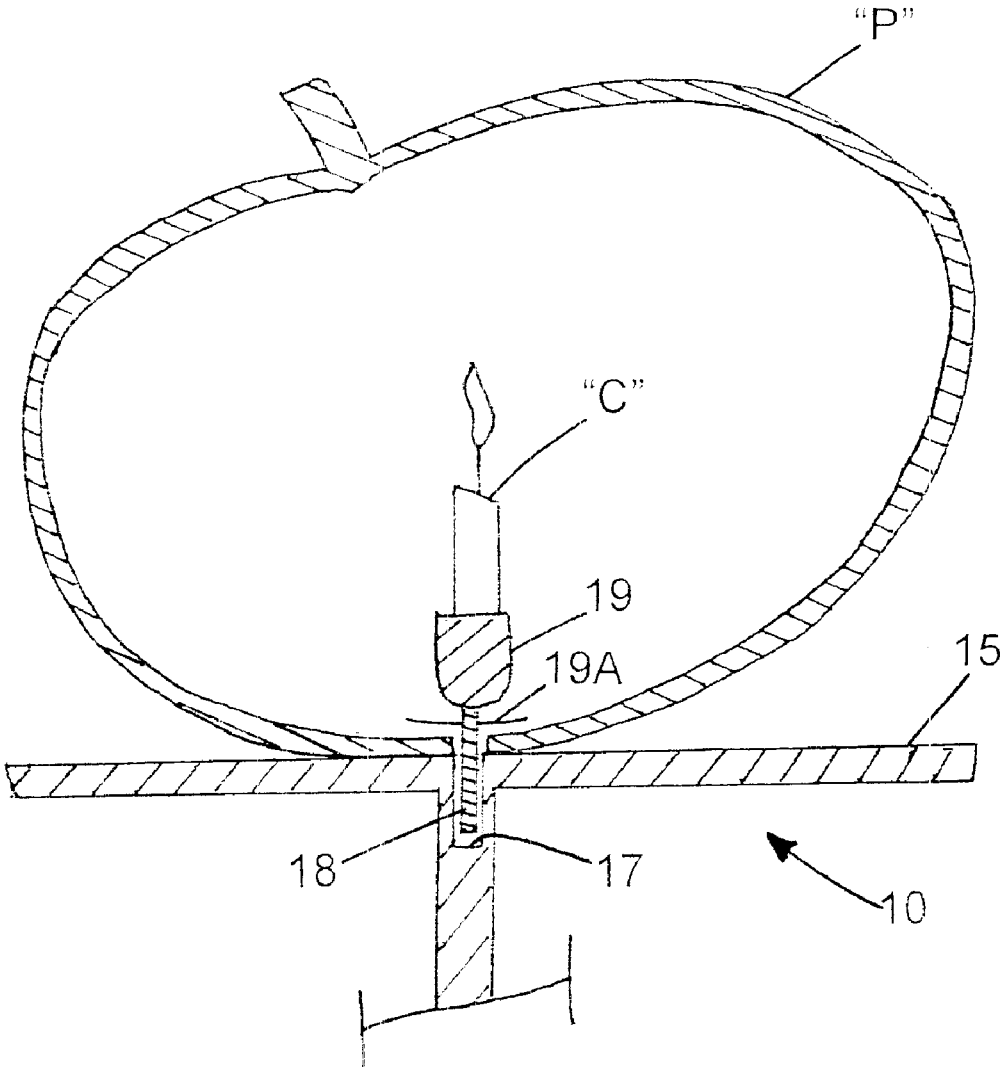
FIG. 6 is a partial, cross-sectional view of the circular base shown in FIG. 5 after the pumpkin has been secured to the base.

Referring now to FIG. 5, the manner in which an object such as a pumpkin "P" is secured to any one of the bases 15, 24, 35, or 44 is shown. Base 15, which contains features identical to those of bases 24, 35, and 44, is shown as a representative example. A tubular extension 17 having threaded interior walls 17A is positioned in communication with bore 16 and extends beneath the base 15 for providing additional vertical support to the pumpkin "P". Elongate threaded member 18 is matingly received through the bore 16 and extension 17. A holder 19 for receiving and supporting a lighting device "C" for lighting the interior of the pumpkin "P" is attached to the elongate threaded member 18. The holder 19 includes a base plate 19A. As is shown in FIG. 6, the base plate 19A engages the interior wall of the pumpkin "P" when the threaded member 18 is secured within the bore 15 and extension 16 for stabilizing the pumpkin "P" on the base 15.

The holder 19 may be used with any suitable lighting device, including but not limited to a wax candle, an incandescent bulb-type candle, or a flashlight. The threaded member 18 is preferably an elongate rod, and may be formed from any suitable material and be of any length.

A display stand for a pumpkin or other fruits and vegetables is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A display stand for displaying at least one object thereon, comprising:

(a) a support including an upper end and a lower end, wherein said lower end is adapted for maintaining said support in a generally upright position relative to a surface upon which the support is placed;

(b) a base connected to said upper end of the support and including an upper surface for receiving and supporting the object thereon, said upper surface defining a threaded bore extending therethrough;

(c) a complementary elongate threaded member adapted for being matingly threaded into said bore and extending in an upright direction above the upper surface for securing the object thereto, thereby stabilizing the object on said base; and (d) a holder carried on said second end of said elongate threaded member for supporting a lighting device for lighting the interior of the object.

2. A display stand according to claim 1, wherein said support is formed from a material selected from a group comprising iron, steel, wood, brass, concrete and plastic.

3. A display stand according to claim 2, wherein said base is formed from a material selected from a group comprising iron, steel, wood, brass and plastic.

4. A display stand according to claim 3, wherein said support comprises at least one elongate leg.

5. A display stand according to claim 4, wherein the lower end of the support is further adapted to permit penetration of the lower end into the surface upon which the support is placed.

6. A display stand according to claim 3, wherein said support comprises a tripodal structure for maintaining the object in an upright position relative to the surface upon which the support is placed.

7. A display stand according to claim 3, wherein said circular base has a diameter between 12 and 24 inches.

8. A display stand according to claim 7, wherein the height of said support is between 24 and 72 inches.

9. A display stand according to claim 8, wherein the height of the support is 36 inches.

10. A display stand according to claim 9, wherein said support includes a three dimensional body molded with a predetermined sculptural design.

11. A display stand according to claim 10, wherein said predetermined sculptural design is selected from a group comprising skulls, bones, skeletons and a ghost.

* * * * *